US010611044B2

(12) United States Patent
Elsen

(10) Patent No.: US 10,611,044 B2
(45) Date of Patent: Apr. 7, 2020

(54) KITCHEN SLICER AND APPLICATOR

(71) Applicant: Börner Distribution International GmbH

(72) Inventor: Wolfgang Klaus Elsen, Speicher (DE)

(73) Assignee: Boerner Distribution International GMBH, Landscheid-Niederkail (DE)

( * ) Notice: Subject to any disclaimer, the term of this patent is extended or adjusted under 35 U.S.C. 154(b) by 0 days.

(21) Appl. No.: 15/577,358

(22) PCT Filed: Feb. 13, 2017

(86) PCT No.: PCT/DE2017/000024
§ 371 (c)(1),
(2) Date: Nov. 28, 2017

(87) PCT Pub. No.: WO2017/137024
PCT Pub. Date: Aug. 17, 2017

(65) Prior Publication Data

US 2018/0154538 A1 Jun. 7, 2018

(30) Foreign Application Priority Data

Feb. 12, 2016 (DE) ..... 10 2016 001 566

(51) Int. Cl.
*B26D 7/08* (2006.01)
*B26D 3/28* (2006.01)

(52) U.S. Cl.
CPC ..... *B26D 7/088* (2013.01); *B26D 3/283* (2013.01); *B26D 2003/285* (2013.01); *B26D 2210/02* (2013.01)

(58) Field of Classification Search
CPC ..... B26D 7/088; B26D 2210/02; B26D 2003/285
See application file for complete search history.

(56) References Cited

U.S. PATENT DOCUMENTS 4,448,808 A * 5/1984 Pearl ..... A41H 3/08 427/208.6
5,745,999 A * 5/1998 Zirkiev ..... A47J 43/25 30/278
5,765,472 A * 6/1998 Kim ..... B26D 3/283 83/167
2004/0205921 A1* 10/2004 Woodruff ..... B05C 17/02 15/230.11
2004/0231482 A1* 11/2004 Boilen ..... B26D 3/283 83/425.3
2005/0005783 A1* 1/2005 De Buyer ..... A47J 43/255 99/537
2005/0081690 A1* 4/2005 Biro ..... A22B 5/208 83/168

(Continued)

FOREIGN PATENT DOCUMENTS

DE 20201400963 * 5/2014 ..... A47J 17/02

*Primary Examiner* — Sean M Michalski
(74) *Attorney, Agent, or Firm* — Fredinand IP, LLC

(57) ABSTRACT

The invention relates to a kitchen slicer for slicing material to be cut, like fruit, vegetables or the like. In a kitchen slicer according to the invention, the applicator is incorporated to act through the guide surface.
The invention additionally relates to an applicator for a kitchen slicer which is configured according to the invention as an attachment piece or as an exchangeable component.

15 Claims, 3 Drawing Sheets

(56) References Cited

U.S. PATENT DOCUMENTS

Figure 1:
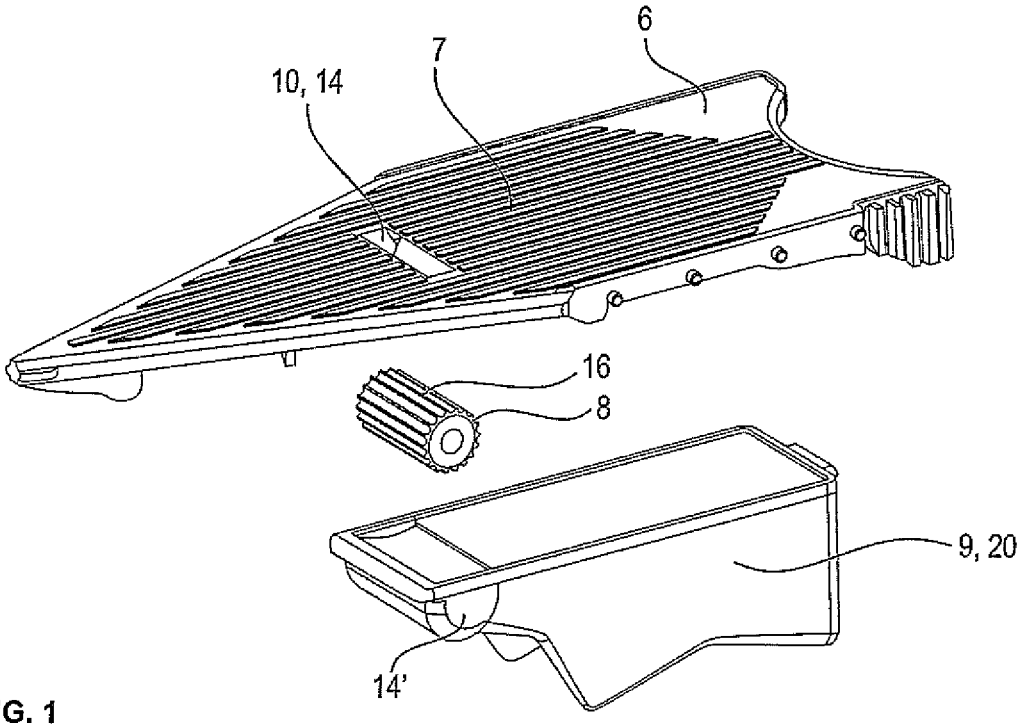

| | | | | |
|---|---|---|---|---|
| 2009/0133587 | A1* | 5/2009 | de Buyer | A47J 43/25 99/537 |
| 2011/0280999 | A1* | 11/2011 | Crystal | A21C 15/002 426/231 |
| 2013/0228057 | A1* | 9/2013 | Stanojevic | B26D 1/553 83/168 |
| 2015/0096177 | A1* | 4/2015 | Ingole | B26D 1/405 30/123 |
| 2015/0208713 | A1* | 7/2015 | Gilardi | A23N 12/02 83/104 |
| 2017/0007062 | A1* | 1/2017 | Elsen | B26B 11/00 |
| 2017/0282394 | A1* | 10/2017 | Hagger | B26D 7/2628 |

* cited by examiner

KITCHEN SLICER AND APPLICATOR

The invention relates to a kitchen slicer with an applicator, and the applicator itself, as is known, for example, from DE 10 2013 019 078 A1, according to the respective preambles of claims 1 and 12.

It is known to use kitchen slicers that have at least one blade to slice food, said blade being fixed in a base body on top of and along which the food is guided. By passing over the blade with the food, the food is sliced into strips and/or slices. The strips or slices that have been cut off are guided downward through the frame and separated from the food. Usually, devices of this type have a guide surface on which the food is guided back and forth up to the blade under application of pressing force.

Cutting blades are known, that for nutritional reasons usefully apply a fluid directly or indirectly onto the blade so that the vegetable may be coated most directly by fluid at the cutting surface during slicing.

There is a desire for an improved solution for slicing food while simultaneously applying fluid.

This problem is solved according to the invention by means of a vegetable slicer and an applicator according to the Main Claims 1 and 12, comprising the respective characterizing features.

Advantageous embodiments, additional features and details of the present invention arise from the dependent claims, the description, and the drawing.

A kitchen slicer according to the invention is suited for slicing material to be cut, like fruit, vegetables, or the like, for example into strips or slices. It has a base body and at least one blade mounted in the base body in order to cut off pieces from the material to be cut. A guide surface is arranged on a feed side of the at least one blade; an insert in the base body is preferably used which has at least one part of the guide surface that is, for example, adjustable in height. The material to be cut is guidable on the guide surface up to the at least one blade. An applicator is designed for the purpose of supplying a fluid directly or indirectly to the blade. According to the invention, the applicator is incorporated in the kitchen slicer and acts through the guide surface or complements the guide surface.

A "blade" in the sense of the invention may generally be understood as a planar, strip-shaped body which has a sharpened cutting edge arranged in a longitudinal direction on a lateral edge. The blade may hereby be manufactured preferably from metal, ceramic, or another material with a high Rockwell hardness. The cutting edge of the blade is any sharp edge of the sharpened cutting edge, wherein this may have different forms. For this purpose, the cutting edge may have, for example, a straight, curved, and/or corrugated shape, in order to be adjusted, for example, to a respective material to be cut for individual purposes. Thus, for example, it may be taken into account that a desired cutting pattern may be created on the cut surface of the material to be cut by means of a scalloped or corrugated blade.

"Acting through the guide surface" in the sense of the invention is generally understood to mean that somewhere in the area of the guide surface, namely, somewhere that the material to be cut is guided past, is to be the place where the applicator acts: either in that the guide surface is designed as fluid permeable in areas and a movable element acting therebeneath as the applicator is at least partly responsible for the fluid supply, or the applicator at least largely replaces the guide surface in its function in areas. An applicator acting through the guide surface therefore also does this in accordance with the invention when it is mounted in the kitchen slicer, for example, complementary to the guide surface, and becomes virtually a moveable part of the guide surface.

Due to the teaching according to the invention, the advantage is achieved that the material to be cut helps to transport the fluid to the blade.

Figure 2:
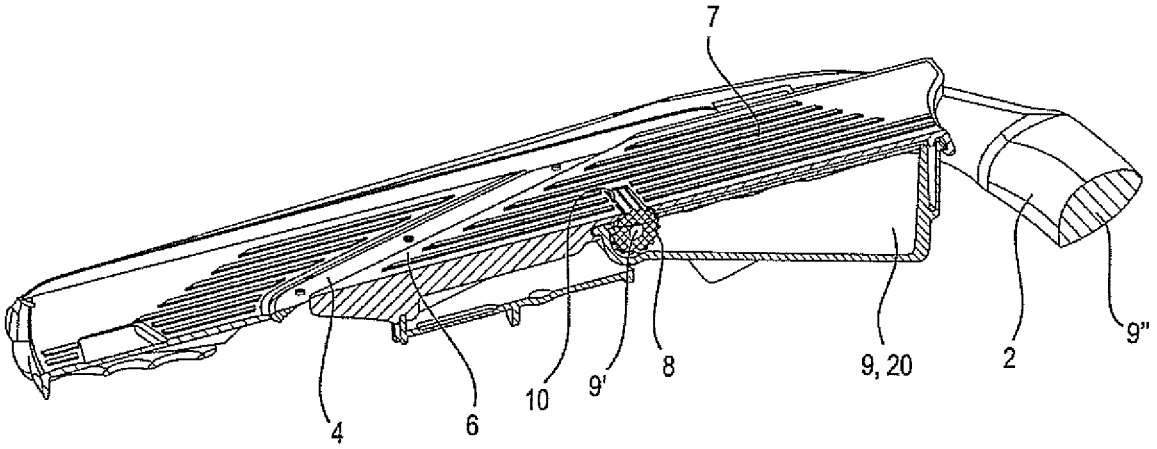
Figure 3:
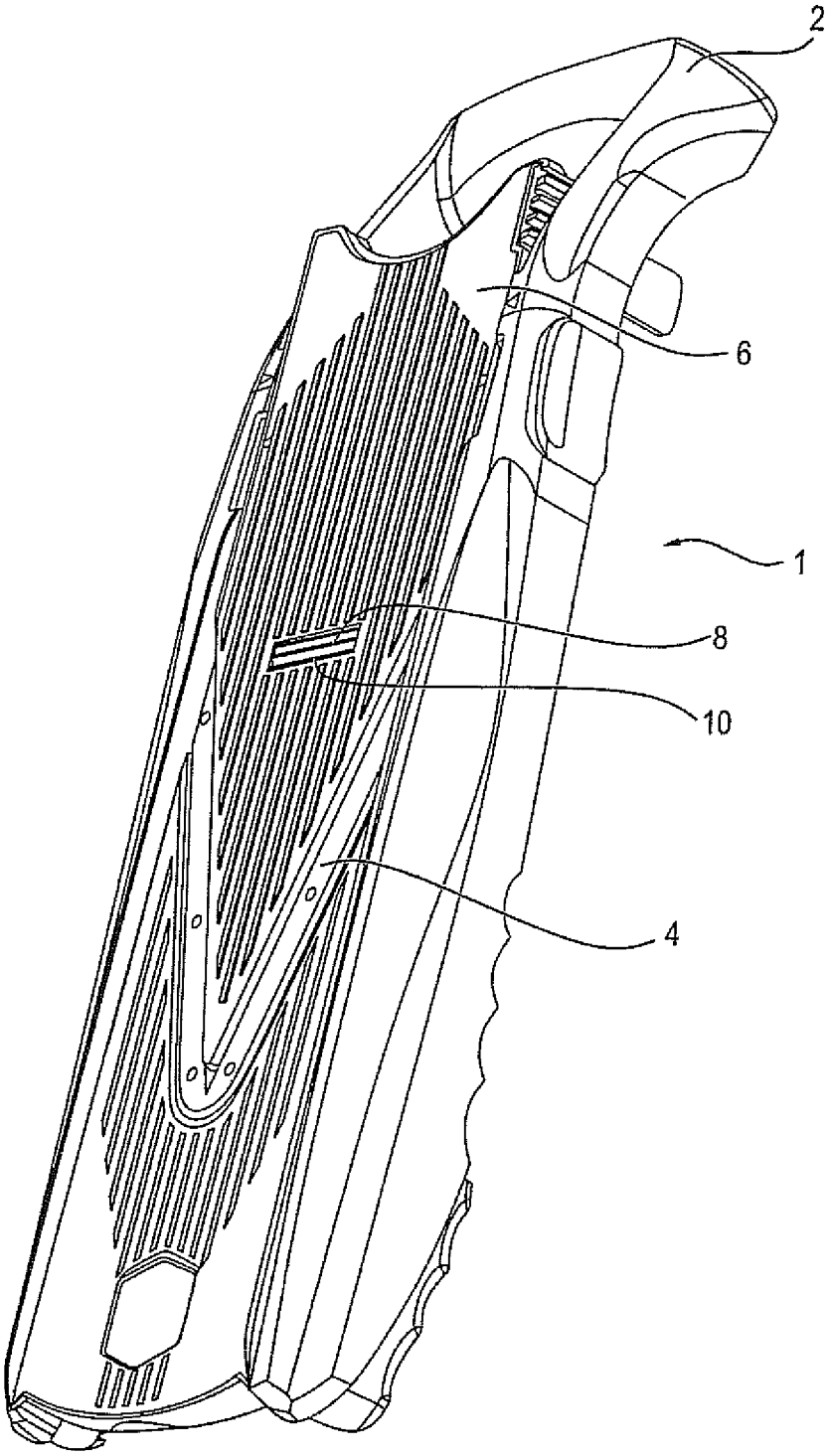
Figure 4:
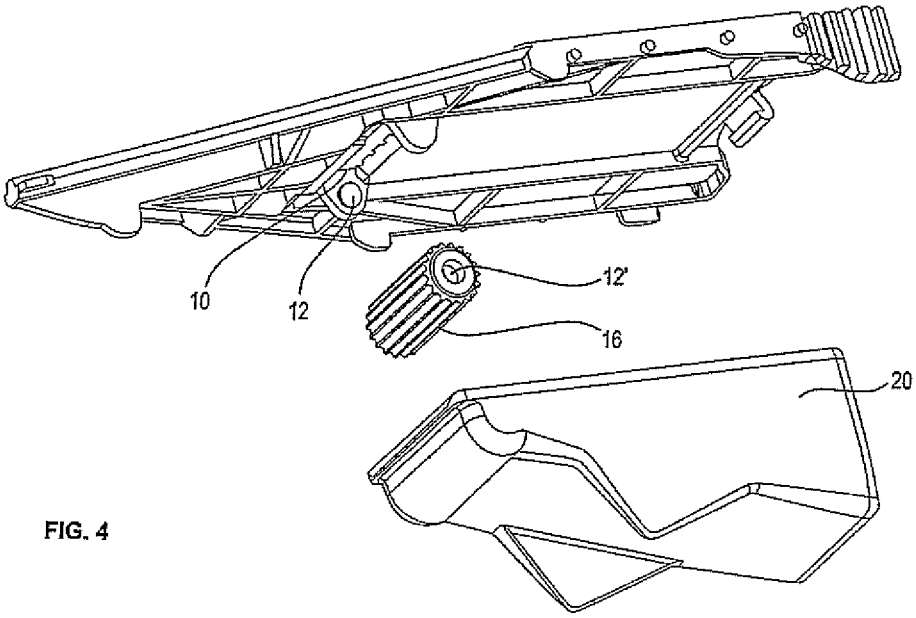
Figure 5:
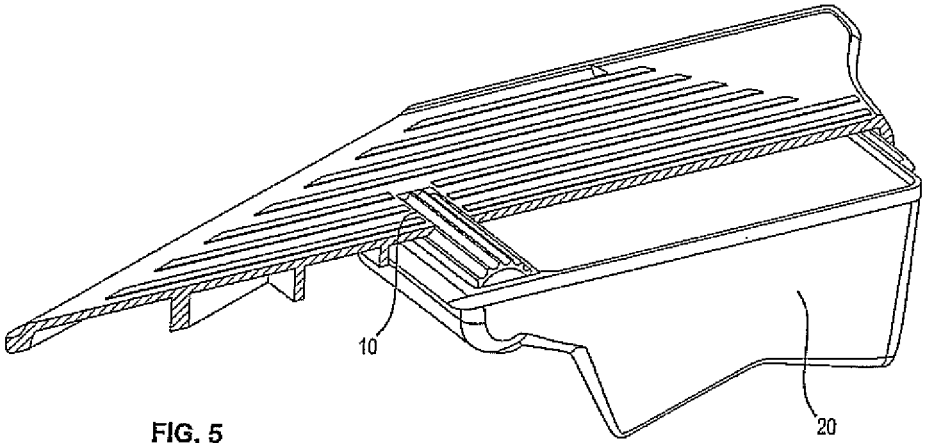
Figure 6:
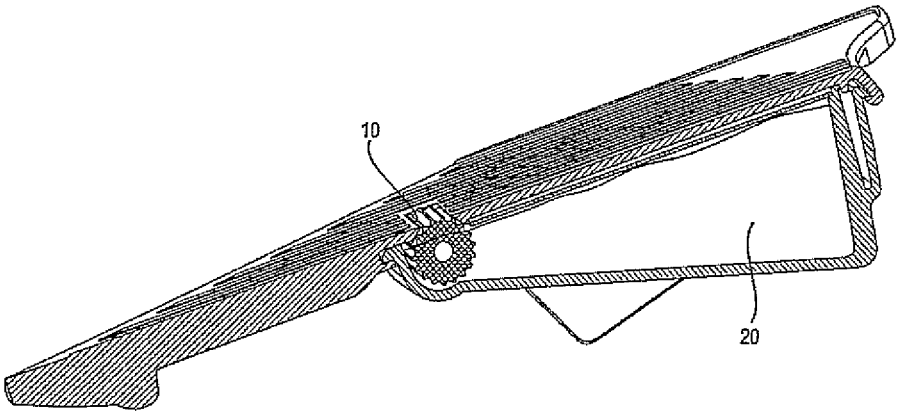

The invention is subsequently described in detail with the aid of one embodiment depicted in the figures, in which, however, alternative embodiments that are likewise according to the invention are indicated with reference numerals with apostrophes. As seen in:

FIG. 1 an exploded depiction of an insert component for use in a kitchen slicer in a perspective view from above with an applicator that may be incorporated in the insert and a container, FIG. 2 a kitchen slicer according to the invention in another perspective view with the insert from FIG. 1 in a longitudinal cutaway view through the vegetable slicer, FIG. 3 the cutaway vegetable slicer from FIG. 2 in another perspective view, FIG. 4 the exploded depiction from FIG. 1 in another perspective view from below, FIG. 5 a break out of the assembled insert according to FIG. 1 in another perspective view, and FIG. 6 another longitudinal cutaway view through the assembled insert according to FIG. 1 in another perspective view.

A kitchen slicer 1 according to the invention is depicted in FIGS. 2 and 3. Kitchen slicer 1 is suited for slicing material to be cut, like fruit, vegetables, or the like. It has a base body 2 with at least one blade 4 fixed in base body 2. Furthermore, it has a guide surface 7 on which the material to be cut is guidable to blade 4.

In the depicted embodiment, guide surface 7 is designed on an insert 6 that may be used in a height adjustable way in vegetable slicer 1. The insert is depicted separately in FIGS. 1 and 4 through 6 for greater clarity. Beyond these depictions, the invention comprises a kitchen slicer that is, however, not shown and which comprises a guide surface fixedly integrated in the base body and likewise additional components essential to the invention that are designed as integrated in the base body, like the subsequently described applicator.

An applicator 8 is shown in FIGS. 1 through 6 and is designed for bringing a fluid (not shown) into contact with the material to be cut (likewise not shown). It is therefore intended to supply a fluid indirectly to blade 4. Applicator 8 is presently incorporated in insert 6 and acts through guide surface 7.

Applicator 8 is movably, namely rotatably, incorporated in the insert. Applicator 8 as depicted is a non-driven, hollow shaft with outer contours and is thus a passive applicator. The applicator is presently rotatably incorporated because an engagement may be carried out on both axial sides, around which engagement the applicator may rotate. The more firmly the seating of the applicator is constructed in the engagement, the greater the amount of friction is required by the material to be cut when passing across it in order to cause the rotation. If the moving applicator rotates in a fluid, then it conveys the fluid, carried along by its radial outer surface, to the material to be cut and with it to blade 4.

Guide surface 7 is used, and thus presently also insert 6, which is spaced apart from blade 4, to position applicator 8 into an opening 10, which interrupts guide surface 7 in the guide direction of the material to be cut, namely into a presently rectangular opening 10 correspondingly configured to the shape of applicator 8. Opening 10 thus lies centered in guide surface 7 of kitchen slicer 1, namely on the longitudinal axis of kitchen slicer 1 aligned in the friction or guide direction. The distance of opening 10 to presently V-shaped blade 4 is approximately 1 to 5 cm.

Applicator 8 is incorporated in a non-destructive releasable way below opening 10 and in insert 6 at least partially penetrating opening 10. The applicator is thus a discharge end of a container 20 facing away from guide surface 7, said container is likewise fixed in a non-destructive releasable way below the insert. Container 20 forms a type of scooped trough for rotatable applicator 8 in the embodiment depicted.

The applicator itself, in a non-depicted embodiment, or a receptacle 14, 14', presently mounted in opening 10 and forming applicator 8, has retaining means 12, 12', presently retaining means 12 configured positively in the receptacle, see FIG. 4. Chamfered shaft ends or pins are suitable, which retaining means 12, 12' assume for applicator 8 a function with regard to the movability of applicator 8 and with regard to a retaining of applicator 8 in relation to guide surface 7. The presently chamfered shaft ends function jointly as an axle for rotatable and hollow applicator 8. Because of the chamfer, the applicator may be pressed between the shaft ends until they spring into the radial interior.

The following is fundamental to the invention, that locations of advantageous embodiments for a fluid reservoir 9, 9', 9" is/are found in base body 2 and/or in insert 6 and/or is/are fixed in a non-destructive releasable way on the insert and/or in applicator 8. They may be configured to be closed, for example, by means of a valve (not shown).

Applicator 8 has a surface contour 16 which comes into contact with the material to be cut and by means of which the fluid delivery quantity is influenced. For different fluids, optionally different contours according to the invention are used. The fluid is conveyable to blade 4 by means of the applicator without any supply line, thus directly from reservoir 9.

LIST OF REFERENCE NUMERALS

1 Kitchen slicer
2 Base body
4 Blade
6 Insert
7 Guide surface
8 Applicator
9 Reservoir
9' Reservoir
9" Reservoir
10 Opening
12 Retaining means
12' Retaining means
14 Receptacle
14' Receptacle
16 Surface contour
20 Container

The invention claimed is:

1. A kitchen slicer (1) for slicing material to be cut, like fruit, vegetables, or the like, comprising a base body (2) and at least one blade (4) fixed in the base body (2) in order to cut off pieces from the material to be cut, comprising a guide surface (7) for guiding material toward the blade (4), and comprising an applicator (8) coupled to the guide surface for supplying fluid to the blade (4), characterized in that the applicator (8) is incorporated in the kitchen slicer (1) and acts through the guide surface (7).

2. The kitchen slicer (1) according to claim 1, characterized in that an insert (6), in the kitchen slicer (1), has at least a part of the guide surface (7).

3. The kitchen slicer (1) according to claim 2, characterized in that the applicator (8) is incorporated in the insert (6).

4. The kitchen slicer (1) according to claim 2, characterized in that the guide surface, and/or the insert (6) has an opening (10), and/or a rectangular opening (10), contiguous with the blade (4) or spaced from the blade (4) and/or partially delimiting or interrupting the guide surface (7).

5. The kitchen slicer (1) according to claim 4, characterized in that the opening (10) is arranged centered in the guide surface (7) on a longitudinal axis of the kitchen slicer aligned in a friction direction, and spaced at a distance of 1 cm to 5 cm from the blade (4).

6. The kitchen slicer (1) according to claim 4, characterized in that the applicator (8) is incorporated below the opening (10) or in the insert (6) at least partially penetrating the opening (10) or in a container (20) fixed in a non-destructive releasable way on the insert (6) facing away from the guide surface (7).

7. The kitchen slicer (1) according claim 2, characterized in that a reservoir (9, 9', 9") for the fluid is arranged in the base body (2) and/or in the insert (6) and/or is fixed in a non-destructive releasable way on the insert and/or in the applicator (8), and is opened or closed by means of a valve.

8. The kitchen slicer (1) according to claim 1, characterized in that the applicator is movable, or rotatable, or passively rotatable.

9. The kitchen slicer (1) according to claim 1, characterized in that the applicator (8) or a receptacle (14, 14') mounting the applicator (8) has retaining means or chamfered shaft ends, and is positively or negatively configured for retaining and moving the applicator (8) in relation to the guide surface (7).

10. The kitchen slicer (1) according to claim 1, characterized in that the applicator (8) has a surface contour (16) for controlling the amount of fluid that contacts the material to be cut.

11. The kitchen slicer (1) according to claim 1, wherein the applicator 8 exclusively supplies fluid to the blade by delivering fluid from the reservoir (9) to the material during slicing.

12. The kitchen slicer (1) according to claim 1, characterized in that the applicator (8) is displaceable into motion without actuating means.

13. The kitchen slicer (1) according to claim 1, characterized in that the applicator (8) is incorporated in the kitchen slicer (1) and partially penetrates the guide surface (7).

14. A kitchen slicer for slicing material to be cut, like fruit, vegetables, or the like, comprising a base body and at least one blade fixed in the base body, a guide surface aligned with the blade and a roller projecting through the guide surface for applying fluid to a material passing over the roller.

15. The kitchen slicer of claim 14 further comprising a reservoir disposed below the guide surface for holding fluid in contact with the roller whereby the roller carries fluid from the reservoir to the material passing over the roller.

* * * * *